US005446640A

United States Patent [19]

Lin

[11] Patent Number: 5,446,640

[45] Date of Patent: Aug. 29, 1995

[54] CHRISTMAS LIGHT

[76] Inventor: Mei Mei Lin, Suite 1 11F, No. 95- 8 Chang Ping Road, Secl, Taichung, Taiwan

[21] Appl. No.: 210,449

[22] Filed: Mar. 21, 1994

[51] Int. Cl.[6] ..... F21V 21/00

[52] U.S. Cl. ..... 362/407; 362/249; 362/391; 362/396; 439/419

[58] Field of Search ..... 362/226, 249, 252, 391, 362/396, 407, 806; 439/414, 419

[56] References Cited

U.S. PATENT DOCUMENTS 3,206,712 9/1965 Schick et al. ..... 439/419
4,159,157 6/1979 Koehler ..... 439/419
4,763,232 8/1988 Woodside ..... 362/249
5,109,324 4/1992 Ahroni ..... 362/226
5,228,774 9/1993 Liao ..... 362/391

*Primary Examiner*—Ira S. Lazarus
*Assistant Examiner*—Y. Quach

[57] ABSTRACT

A Christmas light comprises generally a light stand, a lamp receptacle and contact means thereof. Means are provided on the bottom of the receptacle to stably embed the contact means and the power cables therein. This disclosure has been characterized in a pair of the copperflakes which have spurs to thrust into the cables to transmit electric current to an incandescent bulb mounted on the receptacle and that the cables are jammed in a oval shaped portion of a groove thereof, so as to prevent the cable from being twitched off.

3 Claims, 4 Drawing Sheets

CHRISTMAS LIGHT

BACKGROUND OF THE INVENTION

This invention relates to the intermittent lights, and more particularly to a Christmas light which has a light stand, a lamp receptacle and a contact means of a first and a second copperflake thereof, spur on each copperflake will thrust into the power cables for transmitting electric power to the receptacle to illuminate a blub therein. The thrusted part of the cables are expanded and jammed in an oval shaped portion of a elongate groove in the receptacle in order to prevent the cables from being twitched off.

Prior art Christmas light generally includes a light stand, a lamp receptacle and a contact means, wherein the light stand has a pair of correspondingly opposite vertical projections at its bottom, with one of them having one free end of a hook means thereof. An elongate groove extends across the center on the bottom of the receptacle in addition to a pair of cavities located crosswise with the groove, so as to secure the power cables and the vertical projections therein respectively. The contact means includes a pair of copperflakes having a spur at their ends for respectively thrusting into the power cables inside the groove in order to transmit the electric power to illuminate an incandescent bulb mounted on the receptacle therein.

Yet, there are some shortcomings of the priot art Christmas light remained as follows:

1. In production, the Christmas light above-mentioned will inadvertently make failures instability because; of the spurs of the copperflakes that are not strong enough to effectively thrust into the wires so as to bring about a short circuit to lighten an electric bulb in the receplacle.

2. If the lamp receptacle is incautiously twitched, the cables might be ripped off by the spurs of the copperflakes causing the Christmas light to be shifted about.

3. When bending the cables upward, each top end of the copperflakes will be exposed in the air so as to bring a shortcut of the cables.

SUMMARY OF THE PRESENT INVENTION

The Christmas light of the present invention comprises a light stand, a lamp receptacle and a contact means, wherein the lamp receptacle has a circular bottom comprising an elongate groove extended across the center thereof including a pair of corresponding opposite oval shaped portions extending at opposite ends to define a receiving space for disposing the cables therein. A pair of recesses located on the perpendicular bisector of the groove, and an aperture formed at the center thereof. The contact means comprises a first copperflake and a second copperflake, wherein on one end of the first copperflake is a tilting portion and the other end has a spur, protrudent means are formed at the lateral sides of the spur with a reinforcement groove formed therein-between. Whereas, one end of the second copperflake is a fixing piece and the other end of the second copperflake a spur with a laterally protrudent means, and an U shaped bend formed abutting the fixing piece thereof. When the copperflakes are embedded into the lamp receptacle, the spurs thereof will thrust into the cables as the tilting portion of the first copperflake and the U shaped bend of the second copperflake will touch a tip contact and a ring contact on the bottom of a bulb and illuminate the bulb effectively.

Accordingly, the main object of the present invention is to provide an improved structure of Christmas light with a special design of a first and a second copperflake to be more firmly secured in the lamp receptacle, and a reinforcement device at the spurs thereof would strengthen the thrusting efficiency.

Another object of the present invention is to provide an improved structure of the Christmas light, when the cables disposed in the groove are thrusted by the spurs of the copperflakes, it will be expanded and jammed in the oval shaped portion thereof to prevent the cables from being incautiously twitched off.

The still further object of the present invention is to provide an improved structure of the Christmas lights with a block piece being arranged at each end of the groove. When the cable is bended upward, the block piece may shield to prevent the spurs of copperflakes from exposing in the air. The yet further object of the present invention is to provide an improved structure of the Christmas light, when the U shaped bend of the second copperflake disposes into the aperture at the center on the bottom of the lamp receptacle, a wad means made from fire-proof material is wedged therein in order to secure the second copperflake more steadily in the aperture.

BRIEF DESCRIPTION OF THE DRAWINGS

The present invention will become more readily apparent from the following description of the preferred embodiment of the present invention taken in conjunction with the accompanying drawing, in which.

DETAILED DESCRIPTION OF A PREFERRED EMBODIMENT OF THE PRESENT INVENTION

Figure 1:
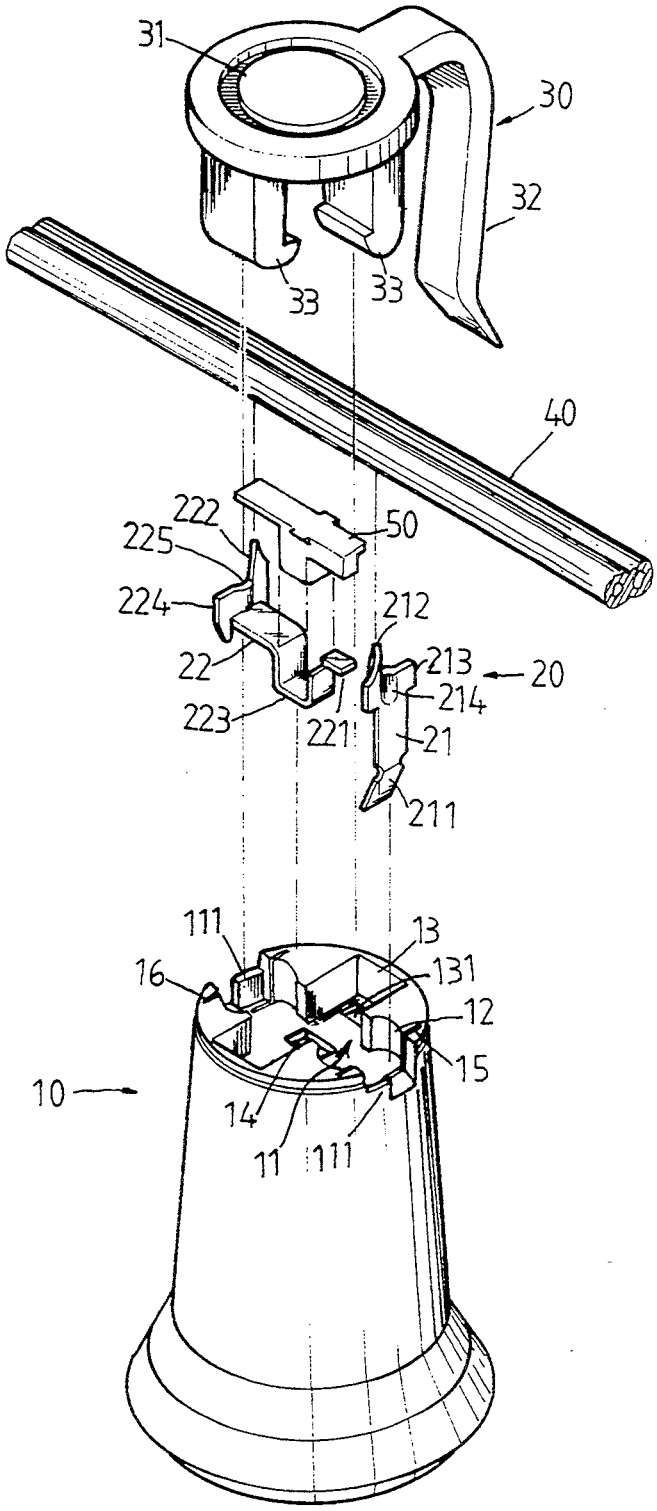
FIG. 1 is an exploded perspective view to show the preferred embodiment of the present invention.
Figure 2:
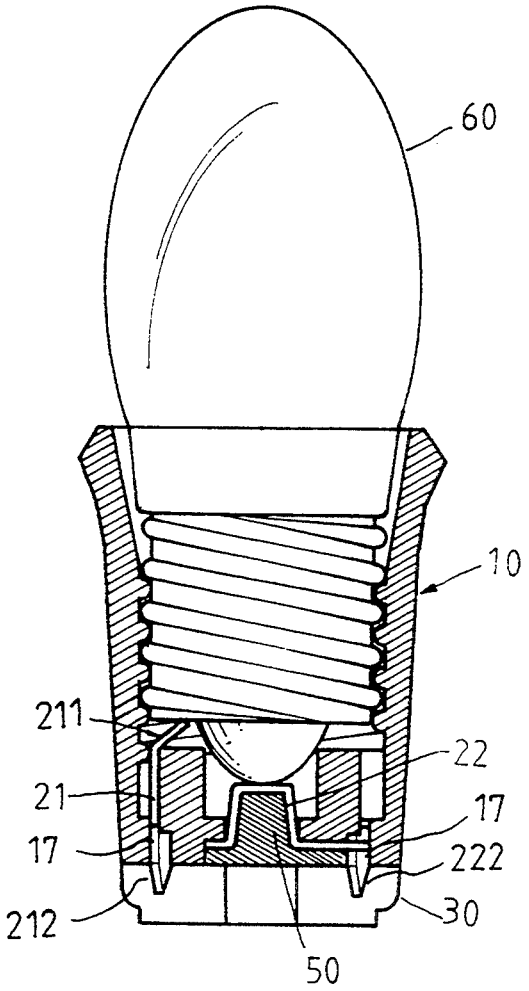
FIG. 2 is a sectional view illustrating the assembly of the present invention.
Figure 3:
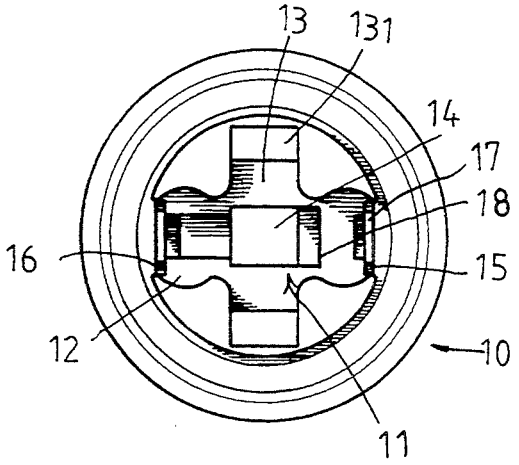
FIG. 3 is a top view of the lamp receptacle of the present invention.

Referring to FIGS. 1, 2 and 3, of the accompanying drawings, the improved structure of the Christmas light of the present invention generally comprises a light stand 30, a lamp receptacle 10 and a contact means 20, wherein a hanger 32 is provided at an outer periphery of the circular body 31 of the light stand 30, and a pair of correspondingly opposite projections 33 with hook at their ends are extended at the circumference therefrom. On one end of the lamp receptacle 10 comprises an elongate groove 11 with a pair of corresponding opposite oval shaped portions 12 extending across the center and at opposite ends thereof to define a space for receiving a two-ply power cable 40 therein, a pair of recesses 13 including a pair of cavities 131 symmetrically formed on the perpendicular bisector of the groove 11 to which the hooks of the projections 33 are secured therein in a snap fitting, an aperture 14 formed at the center thereof, a recess 17 provided abutting each of the oval shaped portions 12 and a block piece 111 formed at each end of the groove 11. The other end of the receptacle is a flare opening having threaded inner periphery for fastening an incandescent bulb 60 therein (shown in FIG. 2). The contact means 20 comprises a first copperflake 21 and a second copperflake 22, wherein one end of the first copperflake 21 is a tilting portion 211, the other end has a spur 212 abutting a pair of laterally protrudent portions 213 formed on both sides under the spur 212 and a reinforcement groove 214 formed between the protrudent portions 213, on one end of the second copperflake 22 is a fixing piece 221, the other end of the second copperflake a spur 222 abutting a lateral protrudent portion 224 and an U shaped bend 223 formed adjacent the fixing piece 221 and intermediate the ends thereof. Same as the first copperflake 21, a reinforment groove 225 is formed under the spur 222. A wad means 50 which is made from the fire-proof material is provided in conforming with the U shaped bend 223 of the second copperflake 22.

With reference to FIG. 2, the way to assembly of the present invention is first of all to insert the tilting portion 211 at the first copperflake 21 downwardly into the recess 17 at one of the oval shaped portion 12, and secondly fix the U shaped bend 223 of the second copperflake 22 into the aperture 14 of the lamp receptacle 10 to let the spurs 212 and 222 of the copperflakes 21 and 22 to be protruded from the bottom of the lamp receptacle 10. The laterally protrudent portions 213 and 224 of the copperflakes 21 and 22 are restrained in the respective slit 15 and 16 in the groove 11 and the fixing piece 221 stops against a stepped surface 18 of the bottom of the groove 11. After the two-ply cables 40 dispose into the groove 11, the hooks of the projections 33 on the light stand 30 are secured into the recesses 131 on the lamp receptacle 10 in a snap fitting, so as to thrust the two-ply cables 40 by means of the spurs 212, 222 of the copperflakes 21 and 22 upon a downward pressure. Finally, the bulb 60 mounts on with the tip contact against the U shaped bend 223 and the ring contact against the tilting portion 211 of the copperflakes 21 and 22 to transmit the electric current from the cables 40 via the copperflakes 21 and 22 to illuminate the bulb 60.

Figure 4:
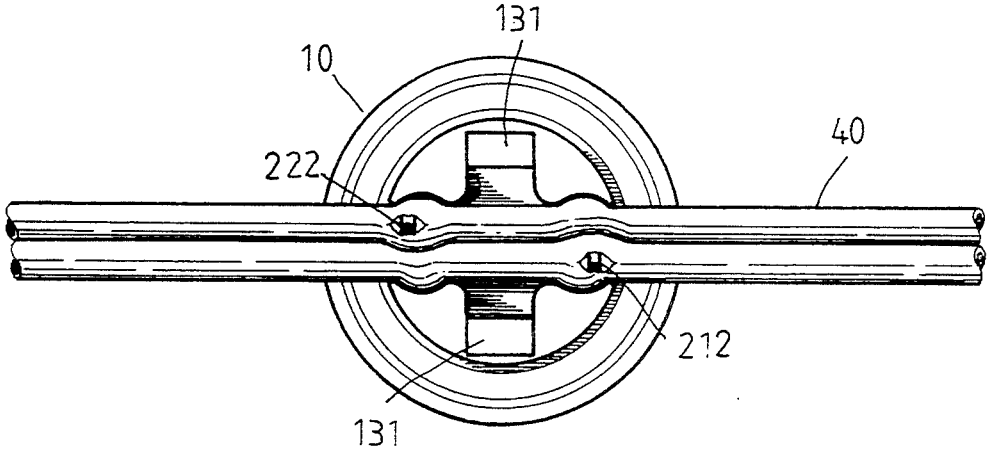
FIG. 4 is a top view illustrating the cables being thrusted by the spurs of the copperflakes and jammed in the oval shaped portions of the groove in accordance with the present invention.
Figure 5:
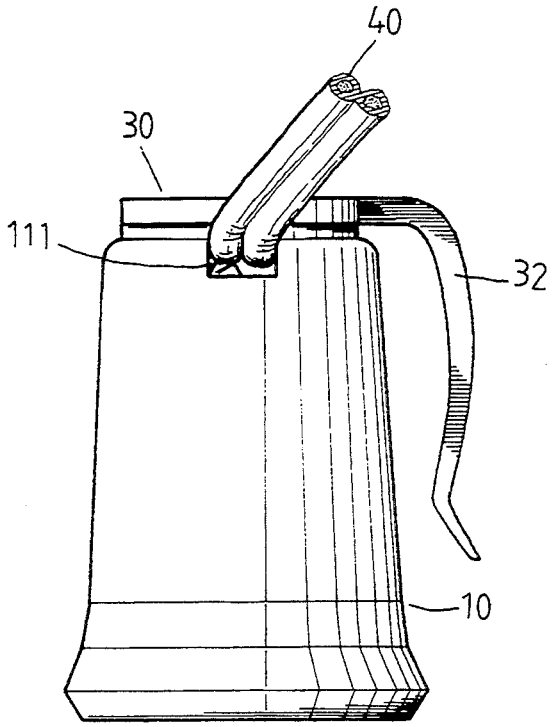
FIG. 5 is a top view illustrating a block piece at the end of the groove shielding to prevent the spurs of the copperflakes from being exposed in the air in accordance with the present invention.

Since the reinforcement grooves 214 and 225 are provided on both the copperflakes 21 and 22, the spurs thereof will be strong enough to thrust into the cables 40 without a frustration or a distortion. Meanwhile, both sides of the cable 40 is ripped to expand laterally and jammed in the oval shaped portion 12 of the groove 11 (as shown in FIG. 4), so as to prevent the lamp receptacle 10 from being incautiously removed from the cables 40. Furthermore, a block piece 111 is provided at each end of the groove 11 (as shown in FIG. 5), in an intention to avoid the copperflakes 21 and 22 being exposed in the air causing a danger of short-circuit, when the two-ply cables 40 are bended upward.

One thing which is worth to mention is that, after the second copperflake 22 is disposed into the aperture 14 of the lamp receptacle 10, the wad means 50 made from fireproof material is wedged onto the U-shaped bend 223 of the second copperflake 22, that a space left above the U-shape bend 223 is to be filled up (as shown in FIG. 2) to guarantee the second copperflake 22 secured in the aperture 14 from loosening up.

Note that the specification relating to the above embodiment should be construed as to exemplary rather than as limitative of the present invention with many veriations and modifications being readily attainable by a person of average skill in the art without aparting from the spirit or scope thereof as defined by the appended claims and their legal equivalents.

I claim:

1. A Christmas light comprising:

light stand having a circular body, a hanger connected to an outer periphery of said body which extends outwardly and downwardly from said body, and a pair of correspondingly opposite projections extended downwardly from said body with hooks on the ends thereof, each of said hooks perpendicularly extended from each projection and face toward one another;

a lamp receptacle having on one end a flare opening and having a threaded inner periphery for fastening an incandescent lamp bulb therein, and another end which has an elongated groove with a pair of corresponding opposite oval shaped portions extending at opposite ends thereof for receiving a two-ply electrical cable therein, said another end of said receptacle further includes a pair of recesses disposed symmetrically and perpendicularly to said groove and bisects said groove to receive said hooks therein respectively, an aperture positioned at a center of said groove, a recess formed on one end of said groove and at a bottom of one of said oval shaped portions, two block pieces each formed at one end of said groove adjacent to said oval shaped portion, two slits each formed at one end of said groove between said oval shaped portion and said block piece; and contact means which are embedded in said slits of said lamp receptacle respectively comprising a first copperflake and a second copperflake, said first copperflake having on one end a tilting portion and another end a spur with laterally protrudent portion and a reinforcement groove therebetween, said tilting portion stops against said recess, said second copperflake having one end a fixing piece, and another end a spur with a laterally protrudent portion and a reinforcement groove therebetween, an u-shape bend abutting said fixing piece and intermediate the ends of said second copperflake, said u-shape bend of said second copperflake being inserted into said aperture, and said first and second copperflakes being fixed to and restrained from said slits, respectively, with said spurs thrusted into said two-ply cables for transmitting the electric current therefrom to a tip contact and a ring contact of said incandescent lamp bulb respectively.

2. A Christmas light according to claims 1, further has a wad member fixed into said U-shape bend of said second copperflake.

3. A Christmas light according to claim 2, wherein said wad member is made from fire-proof material shapely in conforming with said U-shape bend.

* * * * *

US005446640B1

REEXAMINATION CERTIFICATE (3608th)

United States Patent [19] [11] B1 5,446,640

Lin [45] Certificate Issued Aug. 18, 1998

[54] CHRISTMAS LIGHT

[76] Inventor: Mei Mei Lin, Suite I 11F, No. 95- 8 Chang Ping Road, Secl. Taichung, Taiwan

Reexamination Request:
No. 90/004,644, May 19, 1997

Reexamination Certificate for:

| | |
|---|---|
| Patent No.: | **5,446,640** |
| Issued: | **Aug. 29, 1995** |
| Appl. No.: | **210,449** |
| Filed: | **Mar. 21, 1994** |

[51] Int. Cl.[6] ..... F21V 21/00

[52] U.S. Cl. ..... 362/407; 362/249; 362/391; 362/396; 439/419

[58] Field of Search ..... 362/226, 249, 362/252, 391, 396, 407, 806; 439/391, 404, 414, 419, 658, 659

[56] References Cited

U.S. PATENT DOCUMENTS 5,389,008 2/1995 Cheng et al. ..... 439/419

*Primary Examiner*—Alan Cariaso

[57] ABSTRACT

A Christmas light comprises generally a light stand, a lamp receptacle and contact means thereof. Means are provided on the bottom of the receptacle to stably embed the contact means and the power cables therein. This disclosure has been characterized in a pair of the copperflakes which have spurs to thrust into the cables to transmit electric current to an incandescent bulb mounted on the receptacle and that the cables are jammed in a oval shaped portion of a groove thereof, so as to prevent the cable from being twitched off.

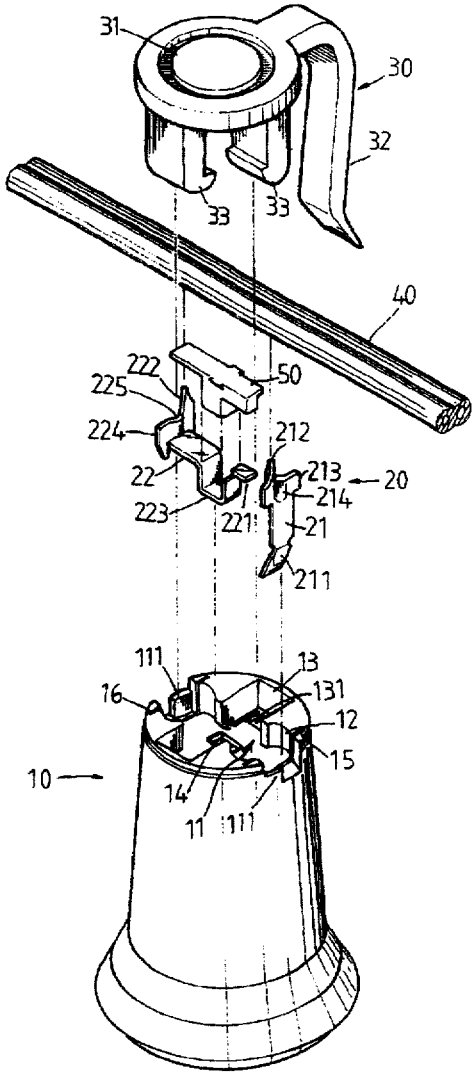

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–3 is confirmed.

* * * * *